US009643100B2

(12) United States Patent
Fein et al.

(10) Patent No.: US 9,643,100 B2
(45) Date of Patent: May 9, 2017

(54) MAGNETIC TOY APPARATUSES AND METHODS

(71) Applicant: Guidecraft, Inc., Winthrop, MN (US)

(72) Inventors: Jason L. Fein, Hastings on Hudson, NY (US); Gary L. Bilezikian, Warwick, NY (US)

(73) Assignee: Guidecraft, Inc., Tuxedo, NY (US)

( * ) Notice: Subject to any disclaimer, the term of this patent is extended or adjusted under 35 U.S.C. 154(b) by 215 days.

(21) Appl. No.: 13/725,954

(22) Filed: Dec. 21, 2012

(65) Prior Publication Data

US 2014/0179194 A1 Jun. 26, 2014

(51) Int. Cl.
*A63H 33/04* (2006.01)

(52) U.S. Cl.
CPC ..... *A63H 33/046* (2013.01)

(58) Field of Classification Search
CPC ..... A63H 33/046; A63H 33/04
USPC ..... 446/92
See application file for complete search history.

(56) References Cited

U.S. PATENT DOCUMENTS

| | | | | |
|---|---|---|---|---|
| 2,872,754 | A | 2/1959 | Cronberger | |
| 3,303,606 | A | 2/1967 | Mann | |
| 3,998,004 | A | 12/1976 | Ehrlich | |
| 4,462,596 | A | 7/1984 | Yamamoto | |
| 4,556,394 | A * | 12/1985 | Chen | A63H 23/005 446/114 |
| 5,048,704 | A | 9/1991 | Takahashi | |
| 5,186,672 | A * | 2/1993 | Tung | 446/95 |
| 5,347,253 | A | 9/1994 | Ogikubo | |
| 5,411,262 | A * | 5/1995 | Smith | 273/157 R |
| 5,520,396 | A | 5/1996 | Therrien | |
| 5,746,638 | A | 5/1998 | Shiraishi | |
| 6,017,220 | A | 1/2000 | Snelson | |
| 6,024,626 | A | 2/2000 | Mendelsohn | |
| 6,431,936 | B1 | 8/2002 | Kiribuchi | |
| 6,749,480 | B1 | 6/2004 | Hunts | |
| 6,846,216 | B1 * | 1/2005 | Balanchi | 446/85 |
| 6,969,294 | B2 | 11/2005 | Vicentelli | |
| 7,038,567 | B2 | 5/2006 | Vicentelli | |
| 7,066,778 | B2 | 6/2006 | Kretzschmar | |
| 7,071,801 | B2 | 7/2006 | Yamazaki et al. | |
| 7,071,802 | B2 | 7/2006 | Hiromori | |

(Continued)

FOREIGN PATENT DOCUMENTS

| | | |
|---|---|---|
| DE | 10 2005 018755 A1 | 10/2006 |
| JP | H05-329279 A | 12/1993 |

(Continued)

OTHER PUBLICATIONS

Rainbow Products, Screen capture of http://www.magformers.com, 2009, retrieved Feb. 13, 2013.

(Continued)

*Primary Examiner* — Aarti B Berdichevsky
*Assistant Examiner* — Urszula M Cegielnik
(74) *Attorney, Agent, or Firm* — Eric D. Ruka; Spilman Thomas & Battle, PLLC

(57) ABSTRACT

A magnetic toy apparatus and method, an embodiment including a plurality of bodies, at least one of which is rod-shaped, the bodies each having voids adjacent to its corners or ends, a plurality of magnets each disposed in one of the voids so as to be freely rotatable to facilitate connecting the bodies to each other by magnetic force.

18 Claims, 15 Drawing Sheets

(56) References Cited

U.S. PATENT DOCUMENTS

| | | | | |
|---|---|---|---|---|
| 7,154,363 | B2 | 12/2006 | Hunts | |
| 7,160,170 | B2 | 1/2007 | Yoon | |
| 7,234,986 | B2 | 6/2007 | Kowalski et al. | |
| 7,255,624 | B2 | 8/2007 | Daftari | |
| 7,273,404 | B2 | 9/2007 | Kowalski et al. | |
| 7,320,633 | B2 | 1/2008 | Park | |
| 7,322,873 | B2 | 1/2008 | Rosen et al. | |
| 7,383,653 | B1 | 6/2008 | Hiromori | |
| 7,413,493 | B2 | 8/2008 | Toht et al. | |
| 7,507,136 | B2 | 3/2009 | Patton | |
| 7,559,821 | B2 * | 7/2009 | Pacheco | 446/108 |
| 7,758,398 | B2 | 7/2010 | Park | |
| 7,833,078 | B2 | 11/2010 | Kretzschmar | |
| 7,887,056 | B2 | 2/2011 | Tenorio | |
| 7,892,065 | B2 * | 2/2011 | Vicentelli | 446/92 |
| 7,955,155 | B2 | 6/2011 | Tremblay et al. | |
| 7,955,156 | B2 | 6/2011 | Toht et al. | |
| 7,985,116 | B2 * | 7/2011 | Song et al. | 446/92 |
| 8,016,635 | B2 | 9/2011 | Park | |
| 8,016,636 | B2 | 9/2011 | Park | |
| 8,100,735 | B2 | 1/2012 | Park | |
| 8,458,863 | B2 * | 6/2013 | Hunts | 24/303 |
| 8,850,683 | B2 * | 10/2014 | Haughey | A63H 33/046 29/428 |
| 2003/0000155 | A1 | 1/2003 | Zwerenz | |
| 2006/0111010 | A1 | 5/2006 | Park | |
| 2007/0100468 | A1 | 5/2007 | Yun | |
| 2010/0087119 | A1 * | 4/2010 | Vicentelli | A63H 33/046 446/92 |
| 2012/0322339 | A1 * | 12/2012 | Kim et al. | 446/92 |
| 2013/0267145 | A1 * | 10/2013 | Rosen et al. | 446/92 |

FOREIGN PATENT DOCUMENTS

| | | | |
|---|---|---|---|
| JP | H08 1387 | U | 9/1996 |
| JP | 2003-521357 | A | 7/2003 |
| JP | 2006-304950 | A | 11/2006 |

OTHER PUBLICATIONS

Rainbow Products, Magformers idea booklet and instructions (http://magformers.com/ideabook/ideabook.pdf), retrieved Feb. 13, 2013.

European Patent Office, Extended search report and opinion, Apr. 30, 2014.

* cited by examiner

MAGNETIC TOY APPARATUSES AND METHODS

FIELD OF THE INVENTION

This invention is related to toys, and more particularly to toys that may include multiple parts that may be magnetically connected.

BACKGROUND OF THE INVENTION

Magnetic toys may include multiple parts that are magnetically connectable to each other to build a structure. A user may wish to connect the parts in various positions and angles relative to each other. However, those positions and angles may be limited by the positioning and orientation of the magnets on or within the parts. For example, one part may not be connectable to another part at points in which the polarities of those magnets do not properly align.

SUMMARY OF THE INVENTION

In an embodiment, a magnetic toy includes: one or more at least three-cornered flat bodies; one or more rod-shaped bodies each having two ends; a plurality of compartments, each corner of each of the one or more at least three-cornered flat bodies and each of the two ends of each of the rod-shaped bodies including one of the plurality of compartments adjacent thereto; and a plurality of magnets, each of the plurality of compartments having one of the plurality of magnets disposed therein, the plurality of magnets freely rotatable in the plurality of compartments for connecting each three-cornered flat body to at least one of the one or more rod-shaped bodies by magnetic force.

In another embodiment, the magnetic toy includes: a plurality of magnets; a plurality of frame-shaped bodies, each frame-shaped body comprising a plurality of corners and a plurality of voids, each of the plurality of voids disposed adjacent to one of the plurality of corners, each of the plurality of voids having one of the plurality of magnets disposed therein; and a plurality of rod-shaped bodies, each rod-shaped body comprising two ends and two voids, each of the two voids disposed adjacent to one of the two ends, each of the two voids having one of the plurality of magnets disposed therein, each of the plurality of rod-shaped bodies for connecting to one or more of the plurality of frame-shaped bodies by magnetic force.

Other embodiments, which may include one or more parts of the aforementioned apparatuses or other parts, are also contemplated, and may thus have a broader or different scope than the aforementioned apparatuses. Thus, the embodiments in this Summary of the Invention are mere examples, and are not intended to limit or define the scope of the invention or claims.

BRIEF DESCRIPTION OF THE DRAWINGS

The accompanying drawings, wherein like reference numerals are employed to designate like components, are included to provide a further understanding of magnetic toy apparatuses and methods, are incorporated in and constitute a part of this specification, and illustrate embodiments of magnetic toy apparatuses and methods that together with the description serve to explain the principles of magnetic toy apparatuses and methods.

Various other objects, features and advantages of the invention will be readily apparent according to the following description exemplified by the drawings, which are shown by way of example only, wherein.

DETAILED DESCRIPTION

Reference will now be made to embodiments of magnetic toy apparatuses and methods, examples of which are illustrated in the accompanying drawings. Details, features, and advantages of the magnetic toy apparatuses and methods will become further apparent in the following detailed description of embodiments thereof.

As used herein, being "freely rotatable" means the ability of an object to rotate in any direction with respect to three axes. Being freely rotatable does not mean that the object will not encounter friction or other force during rotation, such as a friction force via the object sliding during its rotation within another object. Also, being freely rotatable does not mean that the object will necessarily rotate without an outside force, such as a magnetic force. For example, in the embodiments below of the magnetic toy part 1 described with respect to FIGS. 1-6, the magnet 80 in each compartment 70 may rotate in any direction within that compartment, such as when brought into proximity to another magnet, though the magnet 80 may encounter friction by sliding against the compartment 70 during that rotation.

Any reference in the specification to "one embodiment," "a certain embodiment," or a similar reference to an embodiment is intended to indicate that a particular feature, structure or characteristic described in connection with the embodiment is included in at least one embodiment of the invention. The appearances of such terms in various places in the specification do not necessarily all refer to the same embodiment. References to "or" are furthermore intended as inclusive, so "or" may indicate one or another of the ored terms or more than one ored term.

Figure 2:
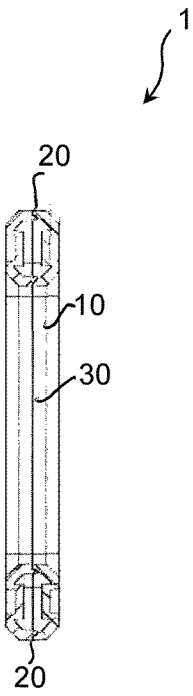
FIG. 2 illustrates a side view of a magnetic toy part, in accordance with one embodiment.
Figure 1:
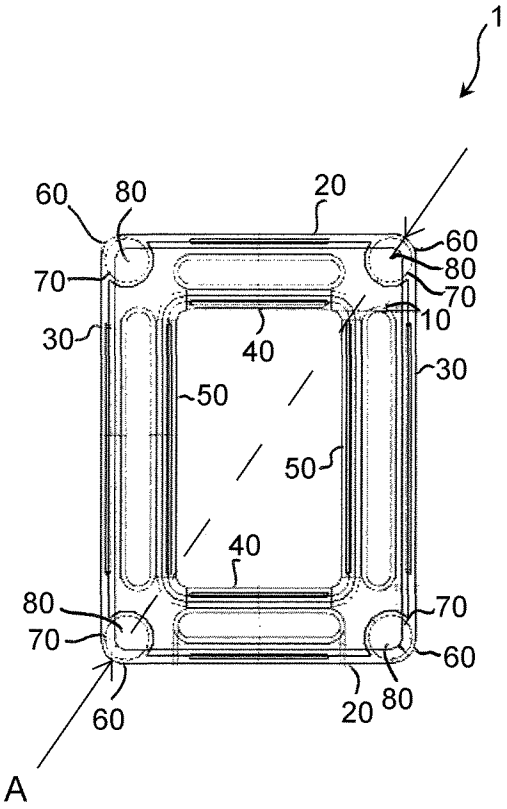
FIG. 1 illustrates a front view of a magnetic toy part, in accordance with one embodiment.

FIGS. 1 and 2 illustrate a front view and a side view, respectively, of a magnetic toy part 1, in accordance with an embodiment. The magnetic toy part 1 may include a body 10 and a plurality of magnets 80 disposed in the body 10. In one embodiment, the body 10 is a flat body. A body may be considered a flat body if its thickness is less than one fourth its greatest corner-to-corner width (or the end-to-end width in the case of the rod-shaped body 310 of the magnetic toy part 300 described below with respect to FIGS. 19-25). Thus, the body 10 in FIGS. 1 and 2 may be considered a flat body if its thickness B as shown in FIG. 2 is less than one fourth that of the greatest corner-to-corner width A as shown in FIG. 1. For example, in an embodiment, the body 10 is a flat body because its thickness B is about 7.9 mm while it greatest corner-to-corner width A is about 77.2 mm. In other embodiments, those dimensions may be different, as desired. Having the body 10 be a flat body may facilitate magnetically connecting multiple bodies 10 (and/or other bodies 110 and 210) of the magnetic toy 1 as "walls" (with or without holes if the bodies are frame shaped, as described below) to form a skeletal structure or framework of a structure, which may be more difficult if using bodies that are not flat.

The body 10 may also be hollow, if desired, thus including one or more cavities inside the flat body 10, as discussed below. A body 10 that is hollow may weigh less than a non-hollow body 10 and thus need less magnetic force to support it.

In an embodiment, the body 10 has a frame shape comprising a rectangular perimeter. Thus, from its front view as shown in FIG. 1, the body 10 has an outer rectangular shape, comprised of parallel sides 20 and parallel sides 30, with an interior hole bordered by interior walls 40 and 50. The frame shape may be such that the interior hole is rectangular such that interior walls 40 are parallel to sides 20 and interior walls 50 that are parallel to sides 30. In another embodiment, the interior hole has a different shape, such as a circle or other shape.

Having the body 10 be frame shaped may make the magnetic toy part 1 lighter than if the body 10 did not have an interior hole. For example, having the body 10 be frame shaped may provide a more stable connection between the magnetic toy part 1 and another magnetic toy part 1 (or 100, 200, or 300 described below) because of a smaller potentially counteractive force of weight of the magnetic toy part 1. If the bodies (10, 110, and/or 210) of the magnetic toy part or parts (1, 100, and/or 200) the magnetic toy part 1 connects with are also frame shaped, the connection may be even more stable. Additionally, having one or more of the aforementioned bodies be frame shaped may allow for more possibilities for connecting the bodies. For example, having frame shaped bodies (10, 110, and/or 210) may allow the rod-shaped body 310 of the magnetic toy part 300 described below to extend through one or more of the bodies (10, 110, and/or 210). Additionally, the frame shaped bodies (10, 110, and/or 210) may allow other parts that are not magnetic toy parts to extend through the interior holes, allowing for more complex structures to be built.

In another embodiment, the body 10 does not have a frame shape and thus does not have an interior hole. In this embodiment, the body 10 may still have a rectangular perimeter but without an interior hole.

In one embodiment, the body 10 may both be a flat body and have a frame shape. An example of such a body 10 would be a body 10 having the frame shape shown in FIG. 1 with a corner-to-corner dimension A being more than four times the thickness B in FIG. 2.

The body 10 may include four corners 60. Each of the four corners 60 may include a compartment 70 adjacent thereto having a void therein. A compartment 70 may be integrally formed with the rest of the body 10, such as partly in each of the top and bottom covers 12 and 14 described below. Each of the four compartments 70 may include a magnet 80 disposed therein. The magnet 80 in each compartment 70 may be freely rotatable within the compartment 70.

In an embodiment, each magnet 80 is spherical. Each magnet 80 in this embodiment may rotate in any direction, such as to align itself when encountering another magnet 80 (or 180, 280, or 380), and thus be freely rotatable. In an embodiment, each compartment 70 includes a spherical void. Thus, the compartment 70 may include a void of the same shape, a sphere, as that of the magnet 80 the compartment 70 contains. The diameter of the spherical void included in the compartment 70 may be only slightly larger than the diameter of the magnet 80 it contains, if desired, to limit translational movement of the magnet 80 while allowing the magnet 80 to freely rotate.

The compartments 70 may be closed such that the body 10 fully encloses the compartments 70. The compartments 70 thus may not have any holes or other passages extending from their voids to completely through the flat body 10. In another embodiment, one or more of the compartments 70 are open such that the one or more compartments 70 each have a hole or other passage extending from the void of the compartment through to the outside of the body 10. In that embodiment, the magnet 80 disposed in each open compartment 70 is least partially exposed.

Figure 5:
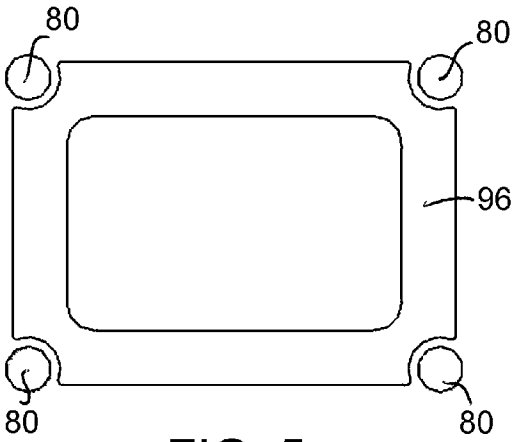
FIG. 5 illustrates a septum and magnets that may be included in a magnetic toy part, in accordance with one embodiment.
Figure 3:
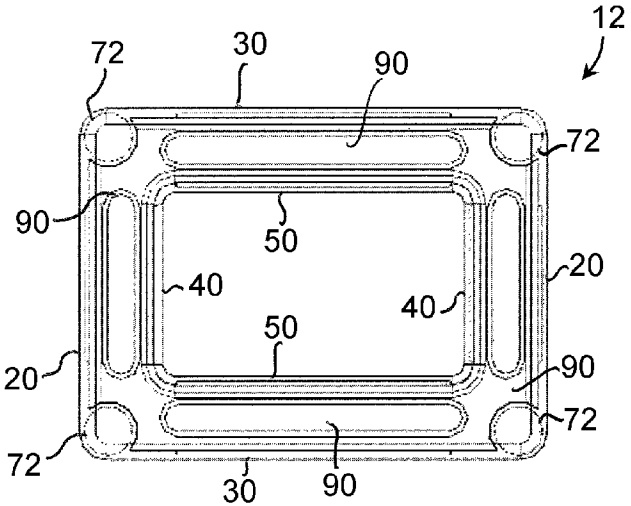
FIG. 3 illustrates a bottom cover that may be included in a body of a magnetic toy part, in accordance with one embodiment.
Figure 4:
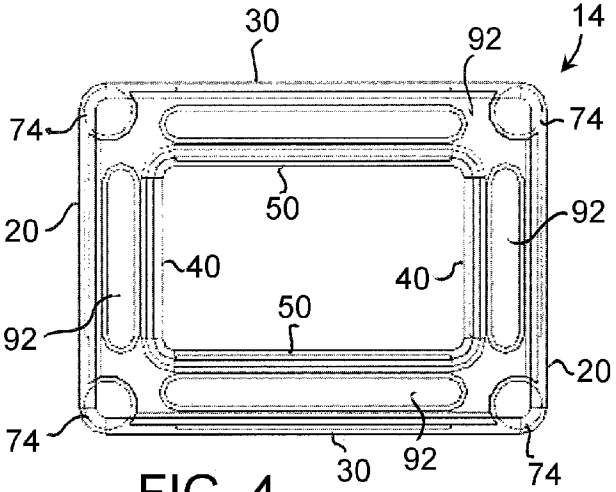
FIG. 4 illustrates a top cover that may be included in a body of a magnetic toy part, in accordance with one embodiment.

FIGS. 3-5 show pieces that may be included in the magnetic toy part 1 shown in FIGS. 1 and 2, in accordance with an embodiment. FIGS. 3 and 4 show a bottom cover 12 and a top cover 14, respectively, that the body 10 of the magnetic toy part 1 shown in FIGS. 1 and 2 may include. FIG. 5 shows a septum 96 that the body 10 may include and further shows the four magnets 80 that may each be disposed in one of the four compartments 70 of the body 10.

Referring to FIG. 3, the bottom cover 12 may include four compartment portions 72. Each compartment portion 72 may form a portion, such as half or another portion, of the one of the four compartments 70 of the body 10. Thus, in an embodiment in which the four compartments 70 each include a spherical void, each compartment portion 72 may include a void that is half or another portion of a sphere. When the body 10 is assembled, the compartment portions 72 may align with the compartment portions 74 of the top cover 14 described below to together form the compartments 70.

As introduced above, the body 10 may be hollow, and thus include one or more cavities therein. In such an embodiment, the bottom cover 12 may include one or more cavity portions 90. The cavity portions 90 may each form a portion, such as half, of one of the cavities of the body 10 when the body 10 is assembled, with the top cover 14 forming the other cavity portions 92 described below.

Referring to FIG. 4 and as with the bottom cover 12, the top cover 14 may include four compartment portions 74 that each form a portion, such as half or another portion, of the one of the four compartments 70 of the body 10. In the embodiment in which the four compartments 70 each include a spherical void, each compartment portion 74 may include a void that is half or another portion of a sphere. As described above, the compartment portions 74 may align with the compartment portions 72 of the bottom cover 12 when the body 10 is assembled to form the compartments 70.

Also, as described above, one or more compartments 70 may be open such that the magnets 80 disposed therein are at least partially exposed. In one embodiment, that exposure may be through both the bottom cover 12 and the top cover 14.

Also as discussed above, in an assembled hollow body 10, the top cover 14 may include one or more cavity portions 92 that align with the cavity portions 90 of the bottom cover 12 to together form cavities in the assembled hollow body 10.

As introduced above, FIG. 5 shows a septum 96 that the body 10 may include in an embodiment and further shows the four magnets 80 that may be disposed in the compartments of the body 10. The septum 96 may be a piece that is positioned between the bottom cover 12 and top cover 14 of an assembled magnetic toy part 1. The septum 96 may be a thin member with a shape similar to the top and bottom covers 12 and 14, respectively. However, the septum 96 may also have voids at its corners, such as shown in FIG. 5, or other areas where the compartments 70 and magnets 80 may be disposed in an assembled magnetic toy part 1. In one embodiment, the magnetic toy part 1 does not include the septum 96.

In other embodiments, the magnetic toy part 1 may include more or less pieces than shown in FIGS. 3-5.

Figure 6:
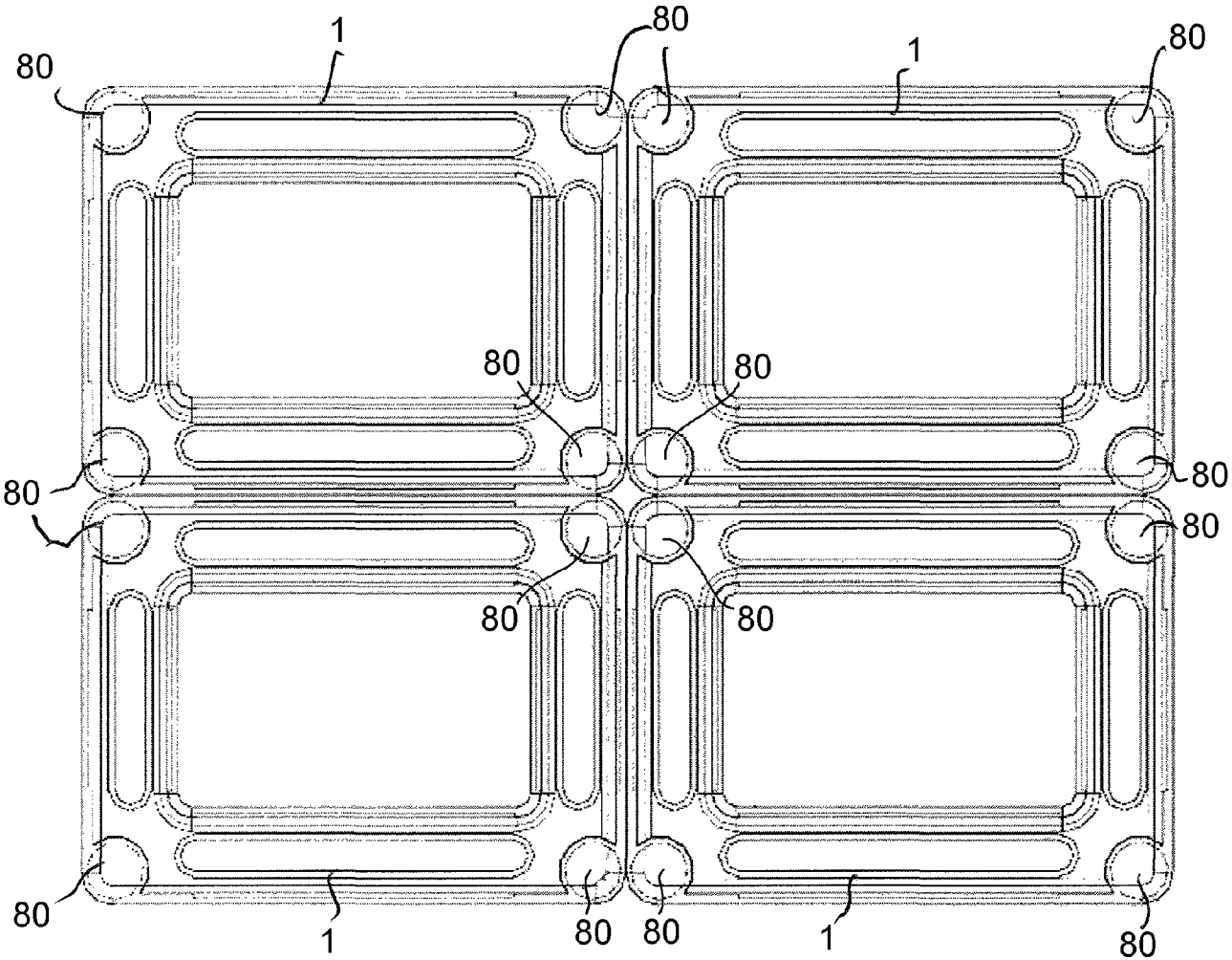
FIG. 6 illustrates four magnetic toy parts positioned and held together by magnetic force, in accordance with one embodiment.

FIG. 6 illustrates four magnetic toy parts 1 positioned and held together by magnetic force. In this embodiment, the magnets 80 of the magnetic toy parts 1 automatically freely rotate when the magnetic toy parts 1 are brought together to align the magnets 80 to create an attractive force between the magnets 80. That force may hold the magnetic toy parts 1 together, with magnetic toy parts 1 tending to align at one or more of each of their corners, such as in the alignment of the magnetic toy parts 1 shown, for example. The magnetic toy parts 1 may be otherwise positioned, such as with their corners 60 meeting each other at different angles.

Figure 8:
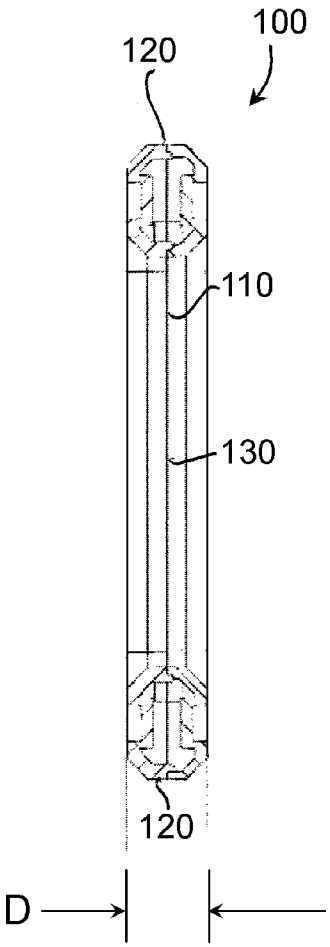
FIG. 8 illustrates a side view of a magnetic toy part, in accordance with one embodiment.
Figure 7:
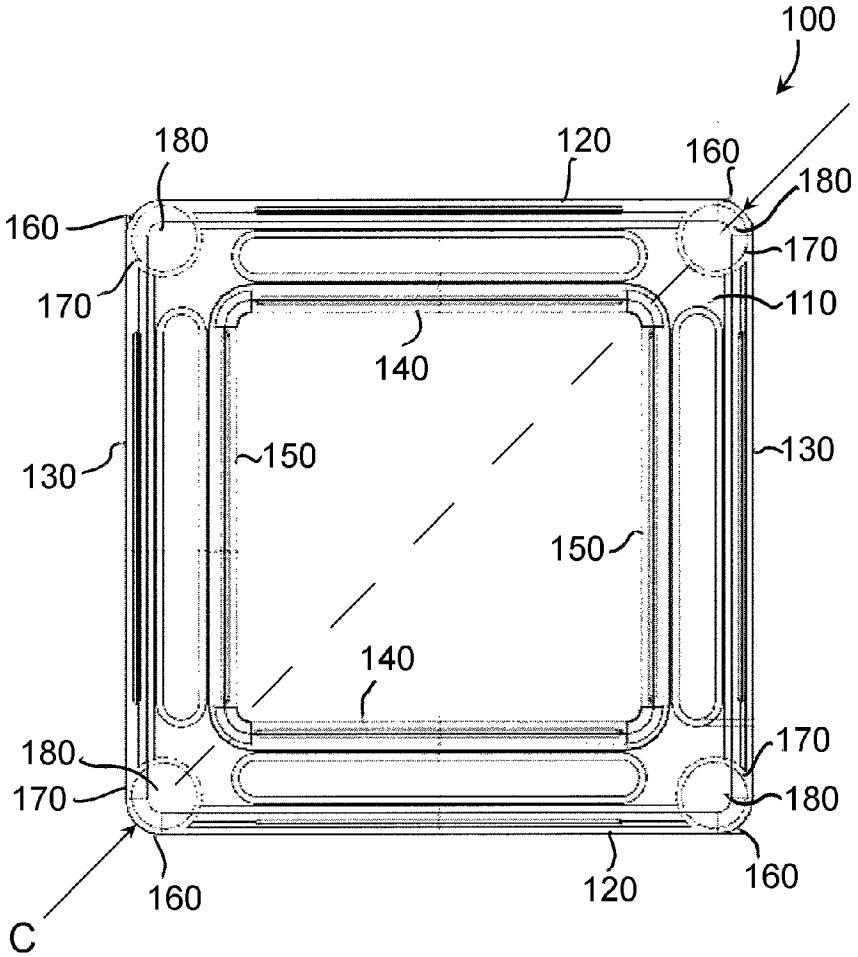
FIG. 7 illustrates a front view of a magnetic toy part, in accordance with one embodiment.
Figure 11:
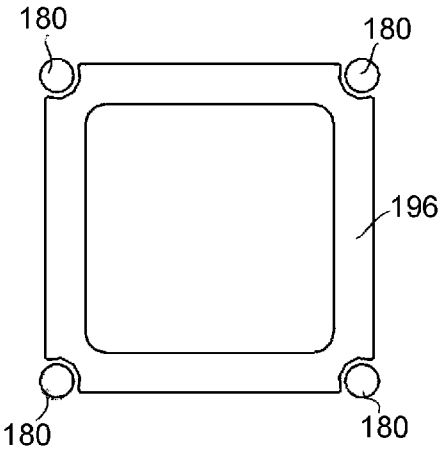
FIG. 11 illustrates a septum and magnets that may be included in a magnetic toy part, in accordance with one embodiment.
Figure 9:
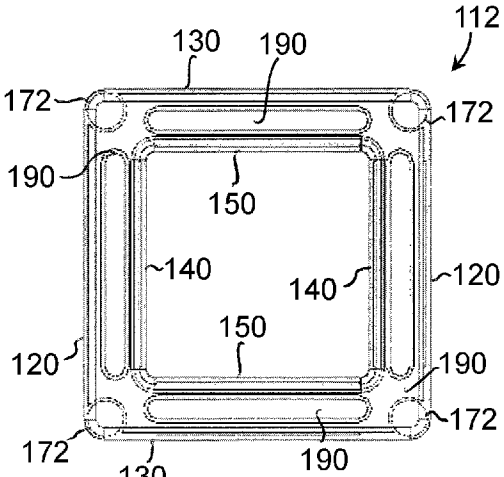
FIG. 9 illustrates a bottom cover that may be included in a body of a magnetic toy part, in accordance with one embodiment.
Figure 10:
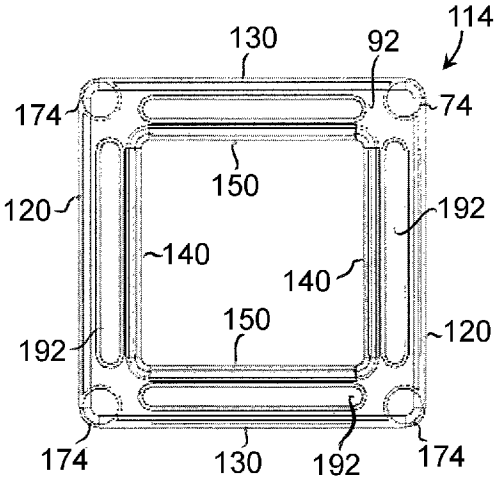
FIG. 10 illustrates a top cover that may be included in a body of a magnetic toy part, in accordance with one embodiment.
Figure 12:
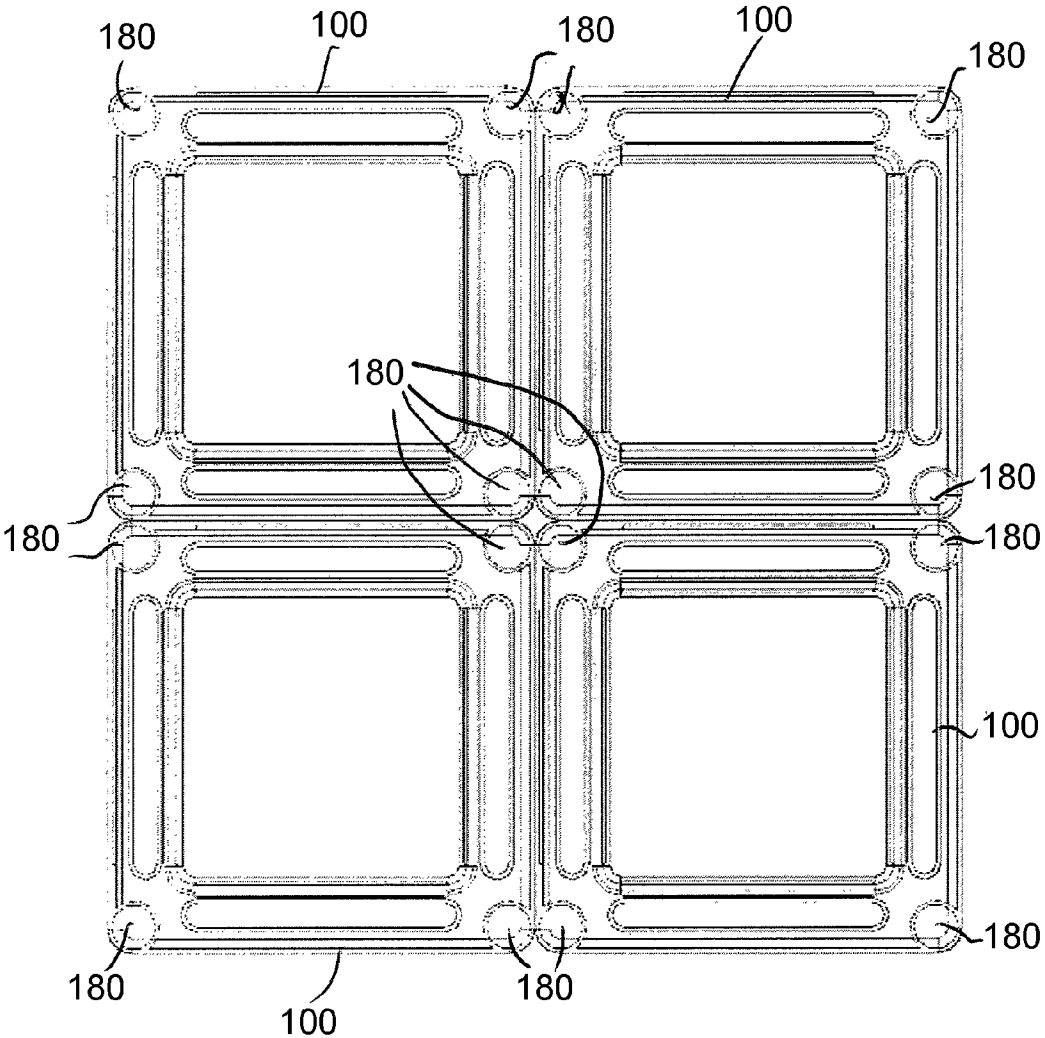
FIG. 12 illustrates four magnetic toy parts positioned and held together by magnetic force, in accordance with one embodiment.

FIGS. 7-12 illustrate another magnetic toy part(s) in accordance with various embodiments. FIGS. 7 and 8 illustrate a front view and a side view, respectively, of a magnetic toy part 100. FIGS. 9 and 10 illustrate a bottom cover 112 and a top cover 114, respectively, that may be included in a body 110 of the magnetic toy part 100. FIG. 11 illustrates a septum 196 and magnets 180 that may be included in the magnetic toy part 100. FIG. 12 illustrates four magnetic toy parts 100 positioned and held together by magnetic force.

In embodiments, elements 110, 112, 114, 120, 130, 140, 150, 160, 170, 172, 174, 180, 190, 192, and 196 of the magnetic toy part(s) 100 and parts thereof illustrated in FIGS. 7-12 correspond to elements 10, 12, 14, 20, 30, 40, 50, 60, 70, 72, 74, 80, 90, 92, and 96 of the magnetic toy part 1 and parts thereof as shown in and described herein with respect to FIGS. 1-6. Thus, for example, the body 110 of the magnetic toy part 100 may, depending on the embodiment, be one or more of the following: a flat body; hollow; and frame shaped.

However, the body 110 may have a frame shape comprising a rectangular perimeter that is, more particularly, a square perimeter. In one example, the body 110 is a flat body because its thickness D as shown in FIG. 8 is about 7.9 mm, less than one fourth its greatest corner-to-corner width C as shown in FIG. 7 of about 87.7 mm.

In other embodiments, as with the body 10 described above, the body 110 may have a frame shape having any of various shapes of interior holes including a square shape, or may not have a frame shape and thus may not have an interior hole. In the embodiment in which the body 110 does not have a frame shape, the body 110 may still have a square perimeter but without an interior hole. As with the body 10, in one embodiment the body 110 may both be a flat body and have a frame shape. In various embodiments, the magnetic toy part 100 may include more or less pieces than shown in FIGS. 9-11.

Figure 14:
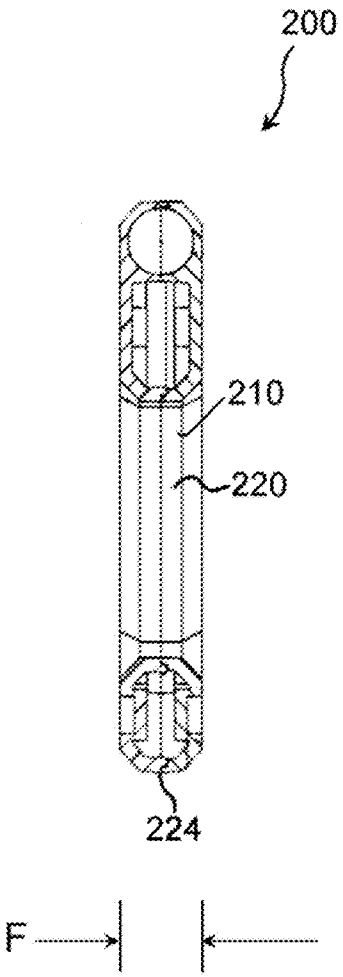
FIG. 14 illustrates a side view of a magnetic toy part, in accordance with one embodiment.
Figure 13:
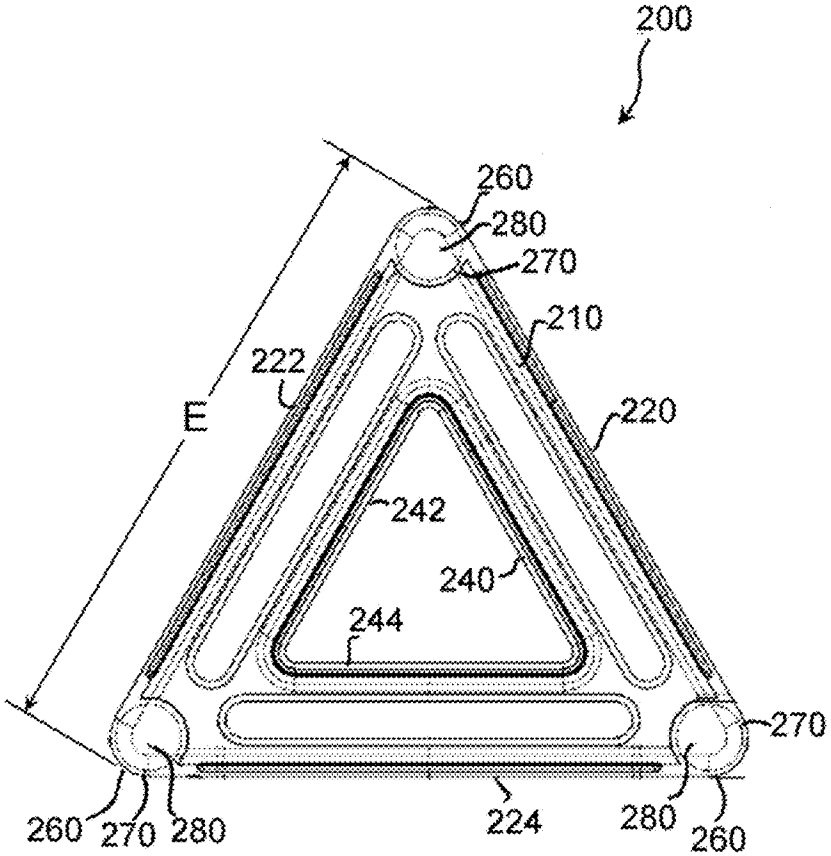
FIG. 13 illustrates a front view of a magnetic toy part, in accordance with one embodiment.
Figure 17:
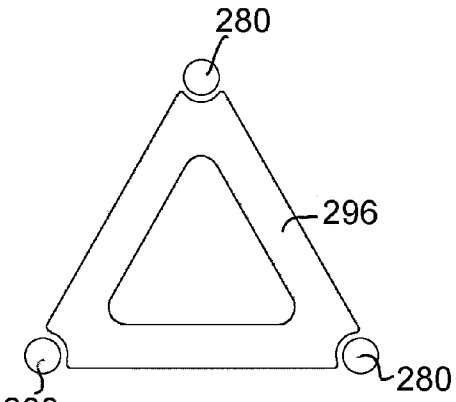
FIG. 17 illustrates a septum and magnets that may be included in a magnetic toy part, in accordance with one embodiment.
Figure 16:
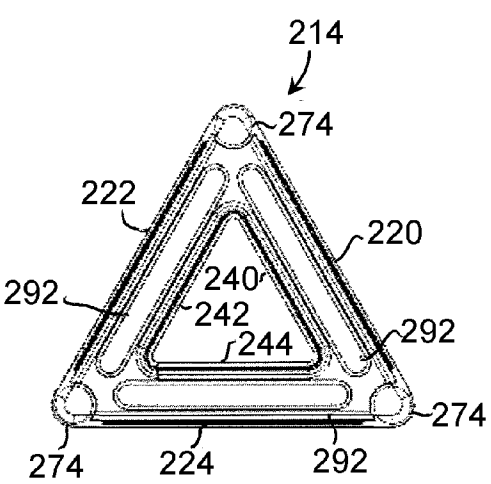
FIG. 16 illustrates a top cover that may be included in a body of a magnetic toy part, in accordance with one embodiment.
Figure 15:
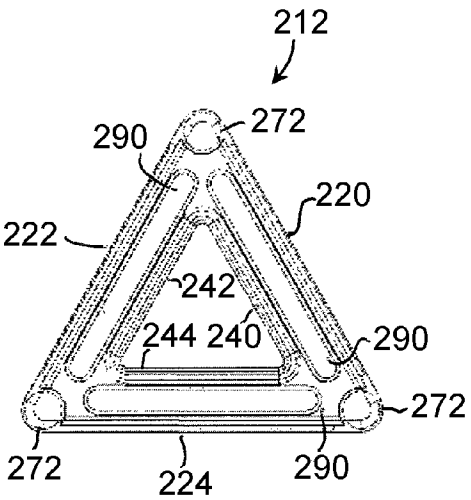
FIG. 15 illustrates a bottom cover that may be included in a body of a magnetic toy part, in accordance with one embodiment.
Figure 18:
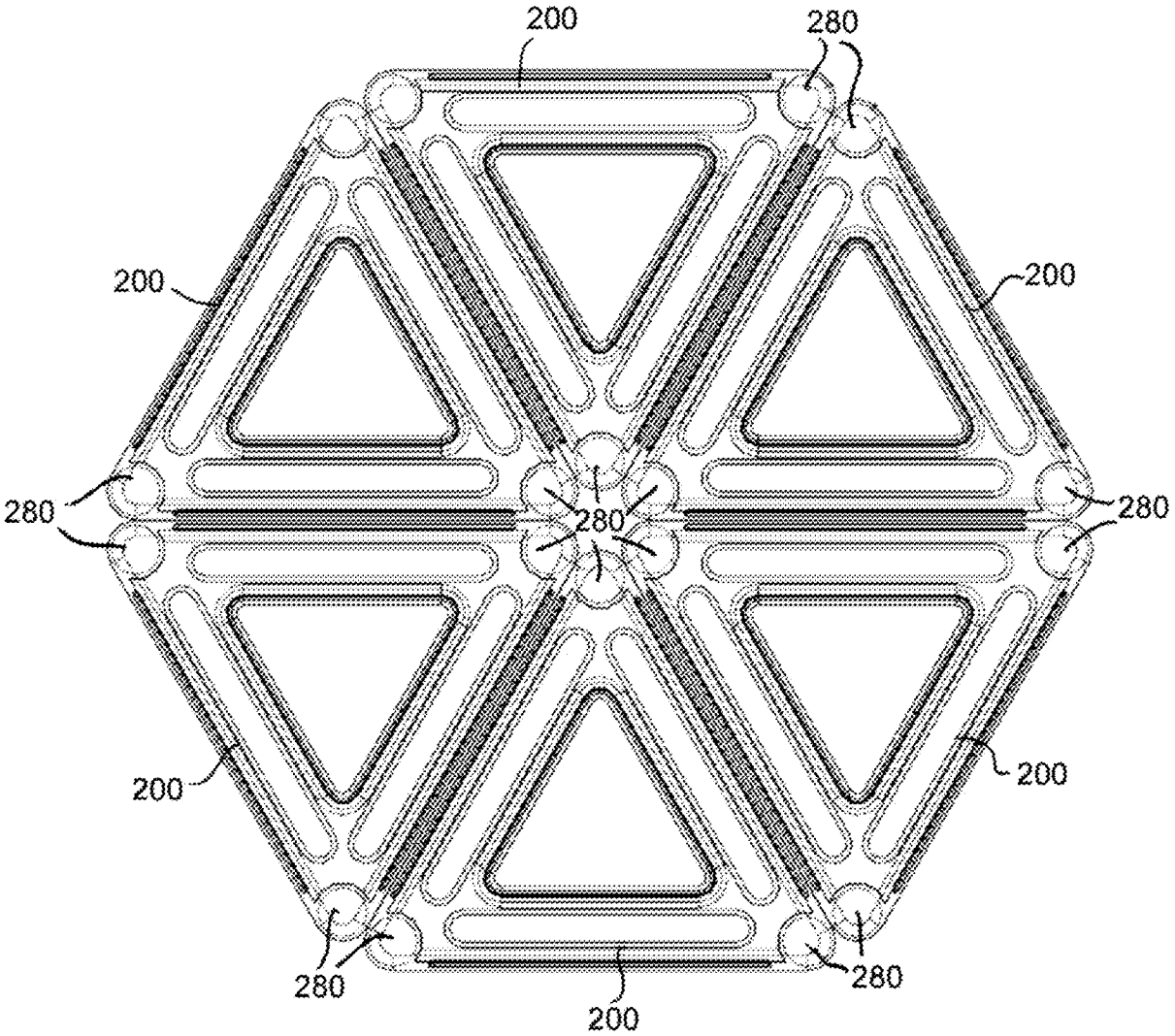
FIG. 18 illustrates six magnetic toy parts positioned and held together by magnetic force, in accordance with one embodiment.

FIGS. 13-18 illustrate another magnetic toy part(s) in accordance with various embodiments. FIGS. 13 and 14 illustrate a front view and a side view, respectively, of a magnetic toy part 200. FIGS. 15 and 16 illustrate a bottom cover 212 and a top cover 214, respectively, that may be included in a body 210 of the magnetic toy part 200. FIG. 17 illustrates a septum 296 and magnets 280 that may be included in the magnetic toy part 200. FIG. 18 illustrates six magnetic toy parts 200 positioned and held together by magnetic force.

In embodiments, elements 210, 212, 214, 260, 270, 272, 274, 280, 290, 292, and 296 of the magnetic toy part(s) 200 and parts thereof illustrated in FIGS. 13-18 correspond to elements 10, 12, 14, 60, 70, 72, 74, 80, 90, 92, and 96 of the magnetic toy part 1 and parts thereof as shown in and described herein with respect to FIGS. 1-6. Thus, for example, the body 210 of the magnetic toy part 200 may, depending on the embodiment, be one or more of the following: a flat body; hollow; and frame shaped.

However, the body 210 may have a frame shape comprising a triangular perimeter. Thus, from the front view as shown in FIG. 13, the body 210 may have an outer triangular shape, comprised of three sides 220, 222, and 224 and an interior hole bordered by interior walls 240, 242, and 244. The body 210 may thus have three corners 260, and thus have three compartments 270 that each has a magnet 280 disposed therein. The frame shape may be such that the interior hole is triangular such that interior walls 240, 242, and 244 are parallel to sides 220, 222, and 224, respectively. In another embodiment, the interior hole has a different shape, such as a circle or other shape.

In another embodiment, the body 210 does not have a frame shape and thus does not have an interior hole. In this embodiment, the body 10 may still have a triangular perimeter but without an interior hole.

As introduced above, the body 210 may be a flat body. In one example, the body 210 is a flat body because its thickness F as shown in FIG. 14 is about 7.9 mm, less than one fourth its greatest corner-to-corner width E (which is equal to the other two corner-to-corner widths in a triangular perimeter embodiment) as shown in FIG. 13 of about 62 mm.

As with the body 10, in one embodiment the body 210 may both be a flat body and have a frame shape. In various embodiments, the magnetic toy part 200 may include more or less pieces than shown in FIGS. 15-17.

Figure 20:
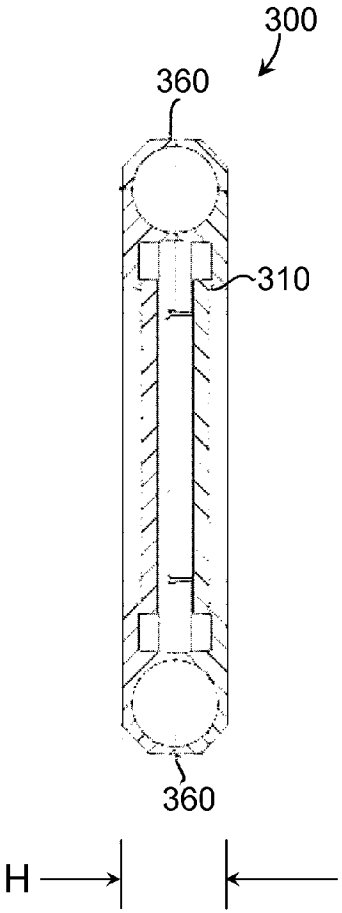
FIG. 20 illustrates a side view of a magnetic toy part, in accordance with one embodiment.
Figure 19:
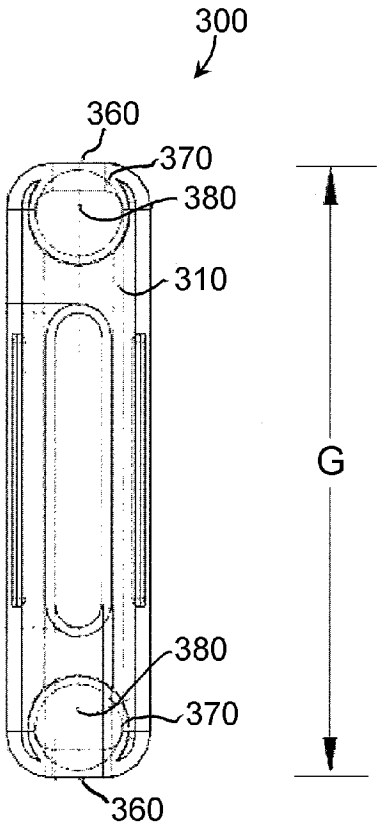
FIG. 19 illustrates a front view of a magnetic toy part, in accordance with one embodiment.
Figure 23:
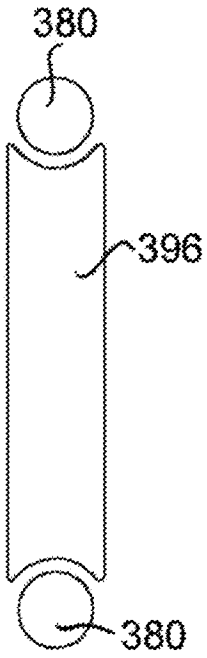
FIG. 23 illustrates a septum and magnets that may be included in a magnetic toy part, in accordance with one embodiment.
Figure 21:
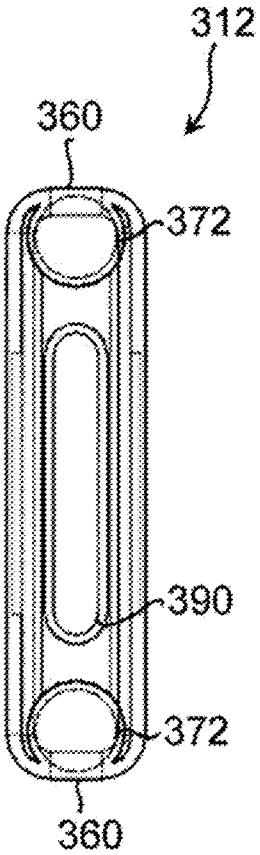
FIG. 21 illustrates a bottom cover that may be included in a body of a magnetic toy part, in accordance with one embodiment.
Figure 22:
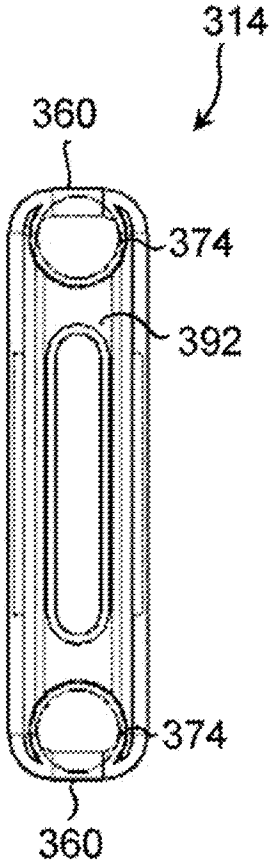
FIG. 22 illustrates a top cover that may be included in a body of a magnetic toy part, in accordance with one embodiment.
Figure 25:
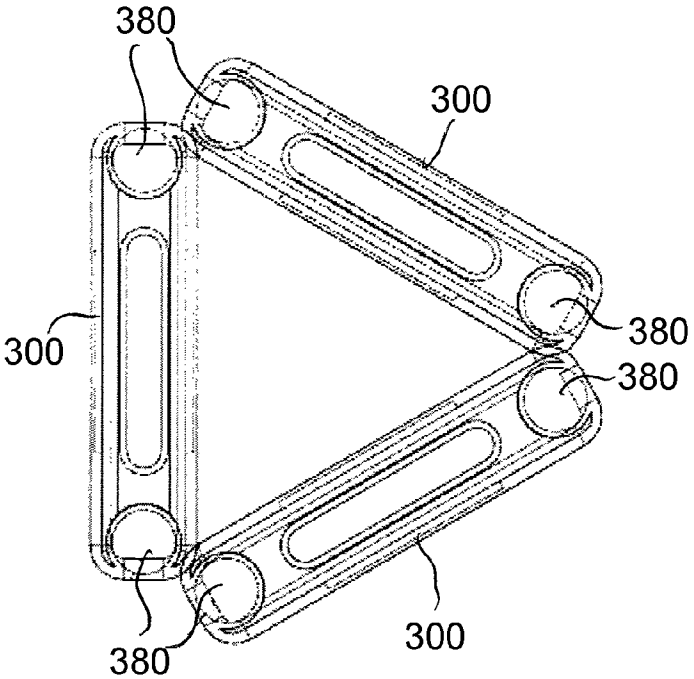
FIG. 25 illustrates three magnetic toy parts positioned and held together by magnetic force, in accordance with one embodiment.
Figure 24:
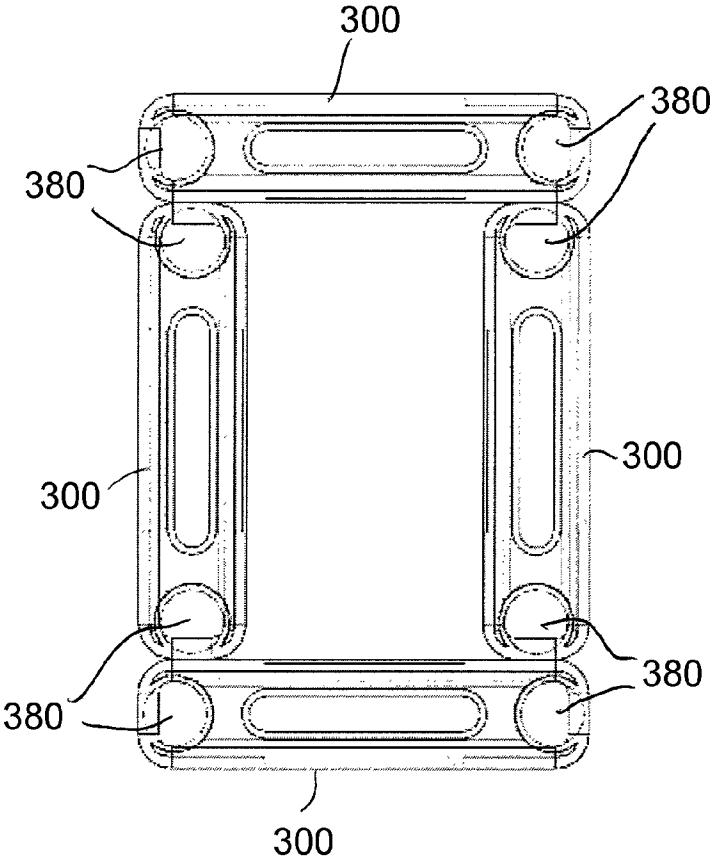
FIG. 24 illustrates four magnetic toy parts positioned and held together by magnetic force, in accordance with one embodiment.

FIGS. 19-25 illustrate another magnetic toy part(s) in accordance with various embodiments. FIGS. 19 and 20 illustrate a front view and a side view, respectively, of a magnetic toy part 300. FIGS. 21 and 22 illustrate a bottom cover 312 and a top cover 314, respectively, that may be included in a body 310 of the magnetic toy part 300. FIG. 23 illustrates a septum 396 and magnets 380 that may be included in the magnetic toy part 300. FIGS. 24 and 25 illustrate four and three magnetic toy parts 300, respectively, positioned and held together by magnetic force.

In embodiments, elements 310, 312, 314, 370, 372, 374, 380, 390, 392, and 396 of the magnetic toy part(s) 300 and parts thereof illustrated in FIGS. 13-18 correspond to elements 10, 12, 14, 70, 72, 74, 80, 90, 92, and 96 of the magnetic toy part 1 and parts thereof as shown in and described herein with respect to FIGS. 1-6. Thus, for example, the body 310 of the magnetic toy part 300 may, depending on the embodiment, be one or more of the following: a flat body; and hollow.

However, the body 310 may be rod-shaped. Thus, from the front view as shown in FIG. 19, the body 310 may be shaped like a rod, which may be straight like an "I" or could be shaped like an "S" or otherwise curved in other embodiments. The body 310 may thus have two ends 360 (as opposed to corners 60 in the body 10 of FIGS. 1-6, for example), and thus have two compartments 370 that each has a magnet 380 disposed therein.

As introduced above, the body 310 may be a flat body. In one example, the body 310 is a flat body because its thickness H as shown in FIG. 20 is about 7.9 mm, less than one fourth its end-to-end width E as shown in FIG. 19 of about 46 mm.

Figure 26:
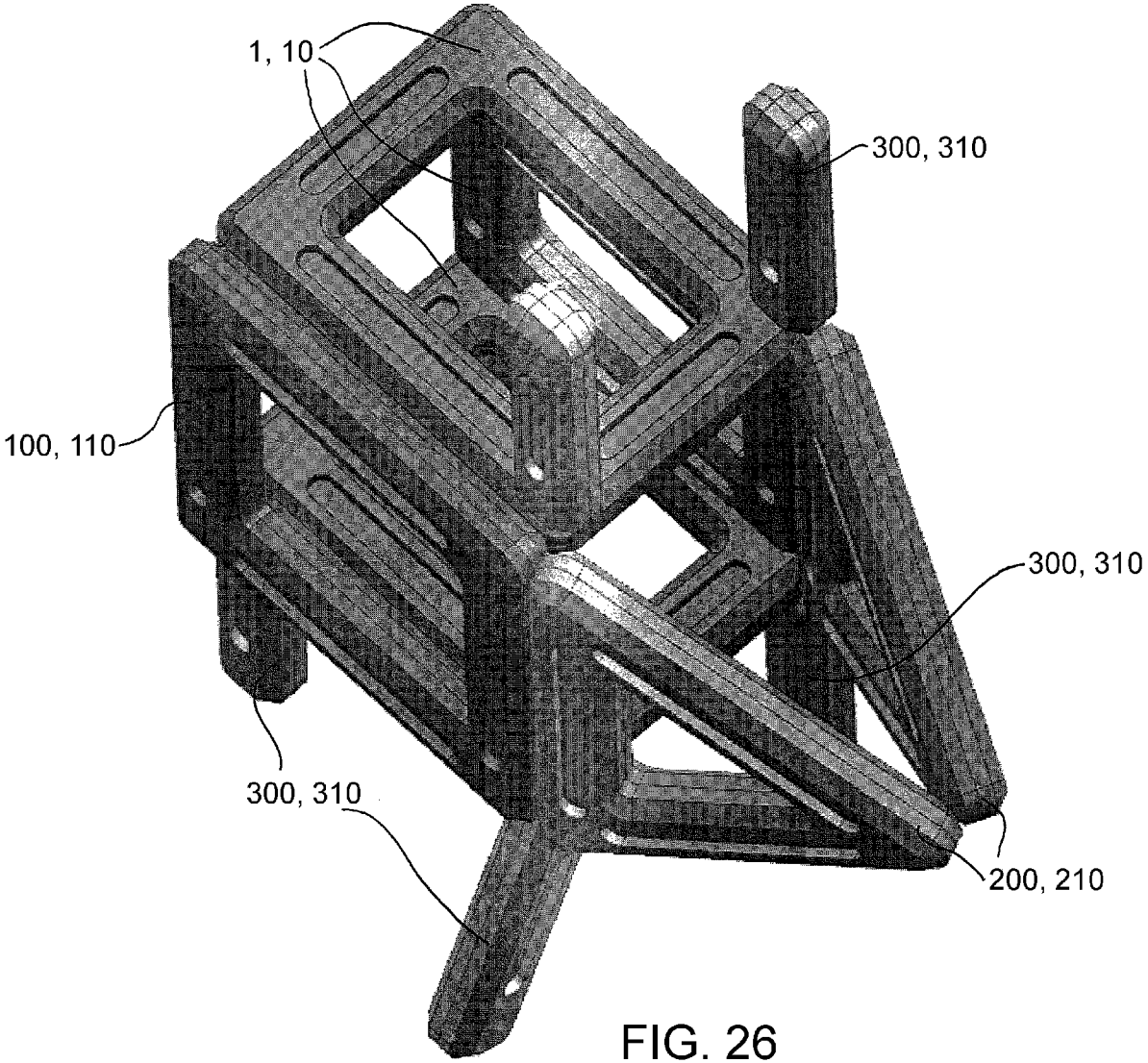
FIG. 26 illustrates a perspective view of various magnetic toy parts positioned and held together by magnetic force, in accordance with one embodiment.
Figure 27:
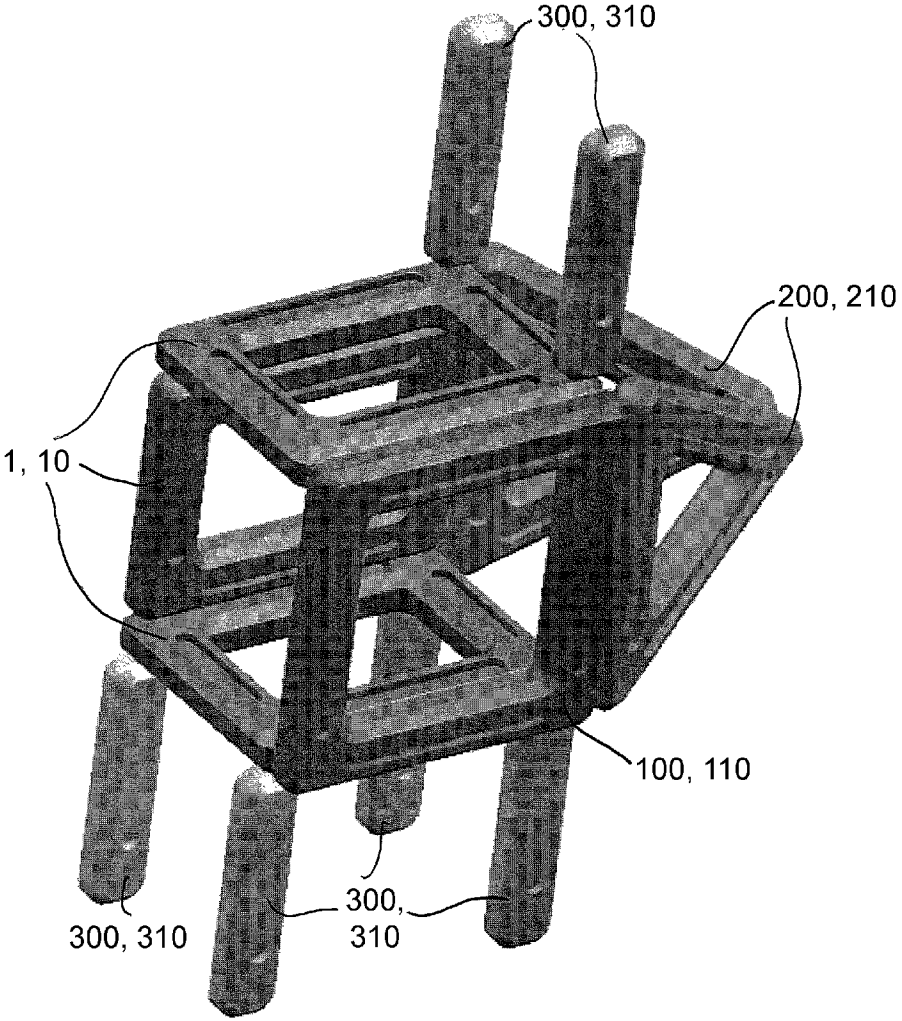
FIG. 27 illustrates a perspective view of various magnetic toy parts positioned and held together by magnetic force, in accordance with one embodiment.
Figure 28:
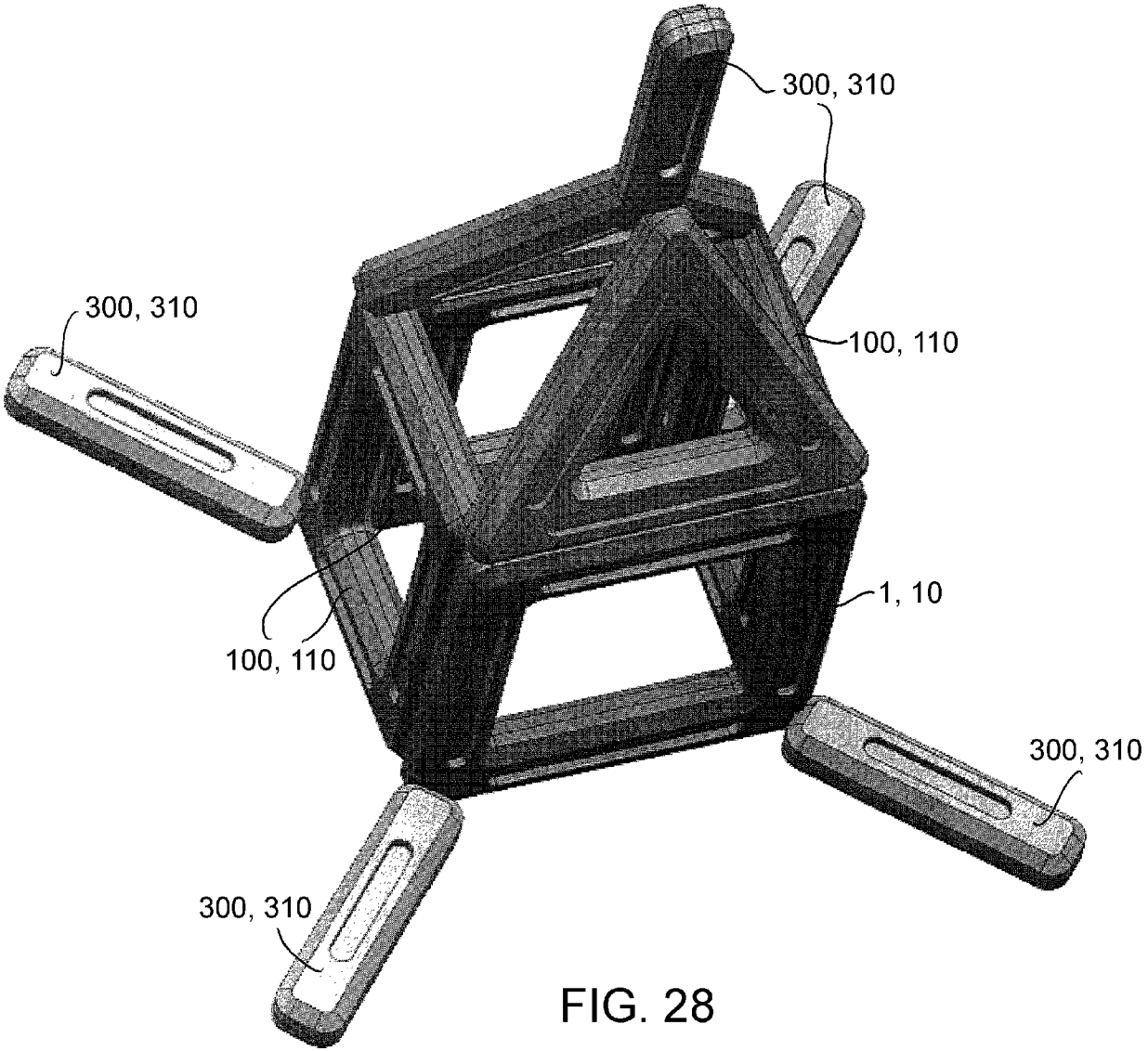
FIG. 28 illustrates a perspective view of various magnetic toy parts positioned and held together by magnetic force, in accordance with one embodiment.

Including magnetic toy parts 300 with rod-shaped bodies 310 in a magnetic toy may facilitate building more varied structures. For example, the rod-shaped bodies 310 may "bridge" two or more bodies 10, 110, and/or 210 of the magnetic toy parts 1, 100, and/or 200, respectively. The rod-shaped bodies 310 may connect at their ends at various angles to the corners of bodies 10, 110, and/or 210 by magnetic force by alignment (by free rotation) of the magnets contained in the bodies 310 and 10, 110, and/or 210, such as shown in FIGS. 26-28 described below, for example. The rod-shaped bodies 310 may also connect to each other at their ends at various angles.

For example, as shown in the embodiment of FIG. 24, four magnetic toy parts 300 are positioned to form a frame shape with a rectangular perimeter. FIG. 25 shows an embodiment in which three magnetic toy parts 300 are positioned at angles to each other to form nearly a frame shape with a mostly triangular perimeter.

In various embodiments, a magnetic toy includes one or more rod-shaped magnetic toy parts 300 and one or more other magnetic toy parts 1, 100, and/or 200. For example, in one such embodiment, the magnetic toy includes at least one rod-shaped magnetic toy part 300 along with one or more magnetic toy parts 1, 100, and/or 200, each of the magnetic toy parts 1, 100, and/or 200 being frame shaped. Thus, the magnetic toy may include at least one rod-shaped body 310 having a void therein adjacent to each of its two ends 360, one or more frame-shaped bodies 10, 110, and/or 210 each comprising a plurality of corners 60, 160, and/or 260, respectively, having adjacently-positioned voids therein, and a plurality of magnets, with each void of the bodies 310 and 10, 110, and/or 210 having one of the magnets (e.g., one of magnets 80, 180, 280, or 380) disposed therein. Each of those magnets may be freely rotatable to facilitate connecting the aforementioned bodies together to form a structure, such as a framework.

In another embodiment, the magnetic toy includes at least one rod-shaped magnetic toy part 300 along with one or more of magnetic toy parts 1, 100, and/or 200, wherein at least the one or more magnetic toy parts 1, 100, and/or 200 comprise bodies 10, 110, and/or 210, respectively, that are flat bodies. Thus, the magnetic toy may include at least one rod-shaped body 310 having a compartment 370 adjacent to each of its two ends 360, one or more bodies 10, 110, and/or 210 each comprising three or more corners 60, 160, and/or 260, respectively, with a compartment 70, 170, and/or 270 adjacent to each corner, and a plurality of magnets, with each compartment of the bodies 310 and 10, 110, and/or 210 having one of the magnets (e.g., one of magnets 80, 180, 280, or 380) disposed therein. Each of those magnets may be freely rotatable to facilitate connecting the aforementioned bodies together to form a structure, such as a framework.

In any of the embodiments described in the above two paragraphs, one or more of the magnetic toy parts of the magnetic toy may have bodies that are hollow.

In another embodiment, the magnetic toy includes a plurality of magnetic toy parts 1 having flat, frame shaped bodies 10 each comprising a rectangular perimeter, at least one magnetic toy part 100 having a flat, frame shaped body 110 comprising a square perimeter, a plurality of magnetic toy parts 200 having flat, frame shaped bodies 210 each comprising a triangular perimeter, and a plurality of magnetic toy parts 300 having flat, rod-shaped bodies 310. The magnets 80, 180, 280, and 380 disposed in the corners and ends of bodies 10, 110, 210, and 310, respectively, as described above, may be spherical and freely rotatable to facilitate connection of the bodies 10, 110, 210 and 310 to form structures such as described herein.

FIGS. 26-28 illustrate perspective views of various of the above magnetic toy parts positioned and held together by magnetic force, in accordance with embodiments. FIGS. 26-28 include magnetic toy part 1, 100, 200, and 300 embodiments with flat bodies, and the magnetic toy parts 1, 100, and 200 are frame-shaped. These figures show just a few of the structural possibilities using the magnetic toy parts described herein.

FIGS. 26 and 27 illustrate a structure constructed using magnetic toy parts 1, 100, 200, and 300 each connected at one or more corners (or ends 360 for magnetic toy parts 300) to one or more other magnetic toy parts 1, 100, 200, and 300. In this embodiment, a construction has been built resembling a mouse or other four-legged animal. The body of the animal includes three magnetic toy parts 1 with flat, frame-shaped bodies 10 with rectangular perimeters and one magnetic toy part 100 with a flat, frame-shaped body 110 having a square perimeter. Each of the four legs and two ears is a magnetic toy part 300 with a flat rod shaped body 310. The head is constructed of two magnetic toy parts 200 with flat, frame-shaped bodies 210 having triangular perimeters. The magnetic toy parts 200 are angled so as to connect one corner to another, forming a "snout" of the animal. One rod-shaped magnetic toy part 300 that forms a leg is angled with respect to the other legs, showing a varied stance.

As described above, having the bodies 10, 110, and 210 be flat facilitates construction of the skeletal structure of the animal. Having the bodies 1, 100, and 200 be frame-shaped may make them lighter than if not frame-shaped, strengthening the integrity of the structure. For example, the rod-shaped parts 300 forming the legs may be more prone to collapsing if the bodies 10, 110, and 210 were not frame-shaped, thus having no interior hole as described above and weighing more. In an embodiment, the bodies 10, 110, 210, and possibly also 310 are hollow to further limit their weight.

FIG. 28 illustrates an embodiment of another structure that may be constructed using the magnetic toy parts 1, 100, 200, and 300. In this embodiment, a framework for another structure, such as a house or spaceship, has been constructed. As shown, including magnetic toy parts 300 with rod-shaped bodies 310 in the magnetic toy allows for numerous construction possibilities, with the bodies 310 connecting with the bodies 10, 110, and 210 of the magnetic toy parts 1, 100, and 200, respectively, at various angles.

As shown in FIGS. 26-28, the magnetic toy parts 1, 100, 200, and 300 are connectable at their corners (or ends 360 for magnetic toy parts 300) at various angles to allow more varies structures than if the magnetic toy parts 1, 100, 200, and 300 could only be connected at their sides or in a more limited range of angles. Having a magnetic toy that includes parts with rod-shaped bodies 310 that are connectable at their ends 360 at various angles allows for more complex and varied structures to be built.

While specific embodiments of the invention have been described in detail, it should be appreciated by those skilled in the art that various modifications and alternations could be developed in light of the overall teachings of the disclosure. Accordingly, the particular arrangements, apparatuses, systems, and methods disclosed are meant to be illustrative only and not limiting as to the scope of the invention.

What is claimed is:

1. A magnetic toy, comprising:

a plurality of hollow flat four-cornered bodies each having a frame shape comprising a rectangular perimeter and an interior hole extending therethrough, each of the hollow flat four-cornered bodies comprising a top cover, a bottom cover, a septum, and four spherical voids, the four spherical voids each disposed adjacent to a different one of the four corners and having a different spherical magnet disposed therein, at least one rectangular perimeter being a square perimeter, each septum positioned between the top cover and the bottom cover of a different one of the plurality of hollow flat four-cornered bodies, each septum comprising four corners and a void at each of the four corners of the septum;

a plurality of hollow flat three-cornered bodies each having a frame shape comprising a triangular perimeter and an interior hole extending therethrough, each of the hollow flat three-cornered bodies comprising a second top cover, a second bottom cover, a second septum, and three spherical voids, the three spherical voids each disposed adjacent to a different one of the three corners and having a different spherical magnet disposed therein, each second septum positioned between the second top cover and the second bottom cover of a different one of the plurality of hollow flat three-cornered bodies, each second septum comprising three corners and a void at each of the three corners of the second septum; and a plurality of hollow flat rod-shaped bodies each having two ends, each of the hollow flat rod-shaped bodies comprising a third top cover, a third bottom cover, a third septum, and two spherical voids, the two spherical voids each disposed adjacent to a different one of the two ends and having a different spherical magnet disposed therein, each third septum positioned between the third top cover and the third bottom cover of a different one of the plurality of hollow flat rod-shaped bodies;

each spherical magnet disposed in the plurality of four-cornered bodies, the plurality of three-cornered bodies, and the plurality of rod-shaped bodies freely rotatable such that the plurality of four-cornered bodies, the plurality of three-cornered bodies, and the plurality of rod-shaped bodies are connectable together at various angles by magnetic force.

2. A magnetic toy, comprising:

one or more at least three-cornered flat bodies, wherein each at least three-cornered flat body is frame shaped such that each at least three-cornered body has an interior hole extending therethrough, and wherein each at least three-cornered flat body comprises an integral top cover and an integral bottom cover and a septum, the septum positioned between the integral top cover and the integral bottom cover, each septum comprising at least three corners and a void at each of the at least three corners of the septum;

one or more rod-shaped bodies each having two ends, and wherein each rod-shaped body comprises a second integral top cover and a second integral bottom cover and a second septum, the second septum positioned between the second integral top cover and the second integral bottom cover;

each corner of each at least three-cornered flat body and each of the two ends of each rod-shaped body including a different compartment adjacent thereto; and each compartment having a different magnet disposed therein, each magnet freely rotatable such that each three-cornered flat body is connectable to at least one of the one or more rod-shaped bodies by magnetic force, the free rotation to align each magnet;

wherein each compartment in each at least three-cornered body is formed partly in the integral top cover and partly in the integral bottom cover of the at least three-cornered body; and wherein each compartment in each rod-shaped body is formed partly in the second integral top cover and partly in the second integral bottom cover of the rod-shaped body.

3. The magnetic toy of claim 2, wherein each magnet is spherical.

4. The magnetic toy of claim 3, wherein each compartment includes a spherical void.

5. The magnetic toy of claim 2, wherein each at least three-cornered flat body comprises four corners.

6. The magnetic toy of claim 2, wherein each at least three-cornered flat body comprises a triangular perimeter.

7. The magnetic toy of claim 2, wherein each at least three-cornered flat body and each rod-shaped body are hollow.

8. The magnetic toy of claim 2, wherein the rod shape comprises an "I" shape.

9. The magnetic toy of claim 2, wherein each compartment is closed.

10. The magnetic toy of claim 2, wherein each compartment is open such that the magnet disposed therein is at least partially exposed.

11. The magnetic toy of claim 2, wherein each rod-shaped body is flat.

12. A magnetic toy, comprising:

a plurality of frame-shaped bodies, each frame-shaped body comprising at least three corners and being frame-shaped such that each frame-shaped body has an interior hole extending therethrough, each corner having a void disposed adjacent thereto, each void having a different magnet disposed therein; and a plurality of rod-shaped bodies, each rod-shaped body comprising two ends and two voids, each of the two voids disposed adjacent to one of the two ends, each of the two voids having a different magnet disposed therein, the plurality of rod-shaped bodies each for connecting to one or more of the plurality of frame-shaped bodies by magnetic force, and wherein:

each rod-shaped body further comprises an integral top cover and an integral bottom cover and a septum, the integral top cover and the integral bottom cover together forming, at each of the two ends of the rod-shaped body, a compartment having one of the two voids of the rod-shaped body therein, each septum positioned between the integral top cover and the integral bottom cover; and each frame-shaped body further comprises a second integral top cover and a second integral bottom cover and a second septum, the second septum positioned between the second integral top cover and the second integral bottom cover, each second septum comprising at least three corners and a void at each of the at least three corners of the second septum.

13. The magnetic toy of claim 12, wherein each magnet disposed in each void of each of the plurality of frame-shaped bodies is freely rotatable and each magnet disposed in each of the two voids of each of the plurality of rod-shaped bodies is freely rotatable.

14. The magnetic toy of claim 12, wherein each magnet disposed in each void of each of the plurality of frame-shaped bodies is spherical and each magnet disposed in each of the two voids of each of the plurality of rod-shaped bodies is spherical.

15. The magnetic toy of claim 14, wherein each void of each of the plurality of frame-shaped bodies is spherical and the two voids of each of the plurality of rod-shaped bodies are spherical.

16. The magnetic toy of claim 12, at least one of the plurality of frame-shaped bodies comprising four corners such that the at least one of the plurality of frame-shaped bodies comprises a rectangular perimeter.

17. The magnetic toy of claim 12, at least one of the plurality of frame-shaped bodies comprising a triangular perimeter.

18. The magnetic toy of claim 12, each of the plurality of frame-shaped bodies and plurality of rod-shaped bodies being flat.

* * * * *